US007427384B2

(12) United States Patent
Kinnunen

(10) Patent No.: US 7,427,384 B2
(45) Date of Patent: Sep. 23, 2008

(54) METHOD OF REDUCING SULFUR DIOXIDE EMISSIONS OF A CIRCULATING FLUIDIZED BED BOILER

(75) Inventor: Pertti Kinnunen, Varkaus (FI)

(73) Assignee: Foster Wheeler Energia Oy, Helsinki (FI)

( * ) Notice: Subject to any disclaimer, the term of this patent is extended or adjusted under 35 U.S.C. 154(b) by 904 days.

(21) Appl. No.: 10/873,166

(22) Filed: Jun. 23, 2004

(65) Prior Publication Data

US 2005/0287058 A1 Dec. 29, 2005

(51) Int. Cl.
*B01D 53/50* (2006.01)
*C01F 11/46* (2006.01)

(52) U.S. Cl. ..... 423/243.08; 423/244.08; 423/555

(58) Field of Classification Search ..... 423/243.08, 423/244.08, 555
See application file for complete search history.

(56) References Cited

U.S. PATENT DOCUMENTS 4,154,581 A 5/1979 Nack et al. ..... 48/197 R
4,309,393 A 1/1982 Nguyen ..... 423/244
4,934,282 A * 6/1990 Asai et al. ..... 110/244
5,171,552 A 12/1992 Miura et al. ..... 423/239
6,569,388 B1 * 5/2003 Fan et al. ..... 422/171
2004/0103830 A1 6/2004 Morin et al. ..... 110/204

FOREIGN PATENT DOCUMENTS

FR 2 796 131 1/2001

OTHER PUBLICATIONS

International Search Report dated Sep. 20, 2005, mailed on Sep. 27, 2005, in corresponding PCT patent application No. PCT/FI2005/000292.

* cited by examiner

*Primary Examiner*—Timothy C Vanoy
(74) *Attorney, Agent, or Firm*—Fitzpatrick, Cella, Harper & Scinto

(57) ABSTRACT

A method of reducing sulfur dioxide emissions of a circulating fluidized bed boiler. Sulfur-containing carbonaceous fuel is fed to a furnace of the boiler, and calcium carbonate is fed to the furnace at a rate relative to the first stream such that the molar ratio of calcium in the second stream to sulfur in the first stream is at most about 1.0. The fuel is combined so that the sulfur is oxidized to form sulfur dioxide. The calcium carbonate is calcined to form calcium oxide and the calcium oxide is used to sulfate the sulfur dioxide to form calcium sulfate. Flue gas particles are separated using a hot loop separator, and the separated particles are returned to the furnace. A sulfur-reduction stage downstream of the furnace further reduces the sulfur content of the flue gases.

27 Claims, 2 Drawing Sheets

METHOD OF REDUCING SULFUR DIOXIDE EMISSIONS OF A CIRCULATING FLUIDIZED BED BOILER

BACKGROUND OF THE INVENTION

1. Field of the Invention

The present invention relates to a method of reducing sulfur dioxide emissions of a circulating fluidized bed (CFB) boiler by incorporating a sulfur-reduction stage in the flue gas path.

2. Description of Related Art

Carbonaceous fuel, such as coal, is combusted in the furnace of a CFB boiler in a bed comprising at least one generally inert material, such as sand, and a sulfur dioxide-reducing additive, such as limestone. A fluidizing gas, usually air, is introduced through a bottom grid of the reactor to fluidize the bed material and to oxidize the fuel. Meanwhile, sulfur in the fuel oxidizes mainly to form sulfur dioxide ($SO_2$), which may be harmful if emitted to the environment in large quantities. At the high temperatures prevailing in the furnace, usually from 750° C. to 900° C., calcium carbonate ($CaCO_3$) of the limestone is calcined to form calcium oxide (CaO), which converts the $SO_2$ to calcium sulfate ($CaSO_4$), which can be removed from the furnace along with the ashes produced in the combustion.

Although a relatively good sulfur-reduction efficiency can be obtained in CFB boilers solely by feeding a sulfur dioxide-reducing additive, usually limestone (calcium carbonate), directly into the furnace, in order to achieve 98% or better reduction efficiency in the furnace, the reducing additive has to be fed into the furnace in abundance to the sulfur in the fuel. For example, whereas limestone often is added at a rate providing a Ca/S molar ratio of at least 1.5 to 3, in order to achieve a very high reduction efficiency of above 98%, Ca/S ratios as high as 4 to 5 are required. With such high Ca/S ratios, the bottom ash and fly ash discharged from the furnace invariably contain a large amount of excess CaO, typically more than 20%, which makes the use or disposal of the ashes difficult.

Another problem associated with the conventional sulfur-reduction process in a CFB furnace is that the calcination of calcium carbonate is an endothermic reaction, with a reaction energy of 178.4 kJ/kmol. Thus, the calcination of excessive amounts of limestone to form calcium oxide decreases the thermal efficiency of the boiler. For example, in order to achieve 98% sulfur reduction when combusting coal containing 2% sulfur, limestone is introduced at a rate providing a Ca/S ratio of 5, and the energy required for calcination reduces the thermal efficiency of the boiler by about 2 percentage points.

U.S. Pat. No. 4,309,393 discloses a sulfur-reduction method for a fluidized bed boiler, wherein limestone is added to the furnace in Ca/S ratios ranging from 1 to 1.5, so as to provide sulfur reduction of 30 to 60% in the furnace. The ashes produced in the furnace, which contain a considerable amount of CaO, are collected and treated for utilization in another sulfur-reduction stage disposed in the flue gas duct downstream of the reactor.

SUMMARY OF THE INVENTION

An object of the present invention is to provide an efficient method of reducing sulfur dioxide emissions of a circulating fluidized bed boiler.

According to a preferred embodiment of the present invention, a method of reducing sulfur dioxide emissions of a circulating fluidized bed boiler comprises steps of (a) feeding a first stream comprising a sulfur-containing carbonaceous fuel to a furnace of the boiler; (b) feeding a second stream comprising calcium carbonate to the furnace at a rate relative to the first stream such that the molar ratio of calcium in the second stream to sulfur in the first stream (the Ca/S molar ratio) is between about 1.2 and about 0.6; (c) combusting the fuel so that the sulfur is oxidized to form sulfur dioxide and ashes are produced in the furnace; (d) calcining the calcium carbonate to form calcium oxide in the furnace and utilizing the calcium oxide to sulfate the sulfur dioxide to form calcium sulfate; (e) discharging flue gases and particles entrained in the flue gases from the furnace; (f) separating the particles from the flue gases using a hot loop separator, and returning the separated particles to the furnace; (g) discharging the ashes from the boiler; and (h) further reducing the sulfur content of the flue gases in a sulfur-reduction stage downstream of the furnace.

Conventional CFB boilers generally rely solely on sulfur reduction in the furnace for purposes of reducing sulfur emissions. More recently, however, as the desired sulfur-reduction level has become as high as 98%, sulfur reduction by feeding limestone only to the furnace requires the use of very high limestone feed rates, corresponding to Ca/S ratios of as high as 5 or greater. This, in turn, increases the sulfur-reducing additive costs, decreases the thermal efficiency of the boiler, and leads to the production of high amounts of CaO-rich ashes. In order to minimize these disadvantages, the desired sulfur reduction can be met by incorporating a further sulfur-reduction stage downstream of the furnace, i.e., in the flue gas path.

The present invention thus relates to an advantageous process for sulfur reduction in a CFB boiler comprising such a further sulfur-reduction stage in the flue gas path. The present invention especially relates to a new method comprising the introduction of sulfur-reducing additive into the furnace of such a boiler at an advantageous feed rate. The invention is based on the observation that the use of sulfur-reducing additive feed rates that are lower than those used conventionally leads to new and considerable advantages in the operation of CFB boilers.

When feeding sulfur-containing fuel into the furnace of a CFB boiler at a fixed rate, the rate of sulfation of sulfur dioxide to form calcium sulfate in the furnace increases with an increasing Ca/S ratio, i.e., with an increasing feed rate of calcium carbonate into the furnace. At low Ca/S molar ratios, the rate of sulfation depends approximately linearly on the calcium carbonate feed rate, but at higher Ca/S ratios the rate of sulfation levels off, at the latest when the sulfur conversion approaches 100%. Correspondingly, the utilization of calcium carbonate is higher at low feed rates than it is at high feed rates.

Assuming that all calcium carbonate fed to the furnace is calcined to form calcium oxide in the furnace, the consumption of energy in the calcination is linearly proportional to the feed rate of the calcium carbonate. However, the sulfation of sulfur dioxide to form calcium sulfate is an exothermic reaction, releasing a heat of 502.4 kJ/kmol, which is more than the heat, 178.4 kJ/kmol, required for the calcination. Thus, at relatively low Ca/S ratios, increasing the calcium carbonate feed rate increases the net heat released in the furnace, but at higher Ca/S ratios an increased calcium carbonate feed rate decreases the net heat released in the furnace.

The preferred calcium carbonate feed rate, in terms of thermal efficiency, depends on the dependence of the rate of sulfation on the Ca/S ratio. This dependence, in turn, depends on the fuel type, especially on the sulfur content of the fuel, and also on the design and operation of the furnace. It has turned out that in typical circumstances a Ca/S molar ratio of about 1.0 is preferable in terms of the thermal efficiency of the furnace. More specifically, as long as the incremental sulfur reduction is at least about 35.5%, i.e., when a share of at least about 0.355, the ratio of 178.4 kJ/kmol to 502.4 kJ/kmol, of added calcium carbonate is converted to calcium sulfate, increasing the calcium carbonate feed rate increases the thermal efficiency.

If the calcium carbonate feed rate is higher than the above-defined optimal value, the sulfur conversion in the furnace is still enhanced, but the thermal efficiency is decreased and the amount of calcium oxide in the ashes is increased. Correspondingly, when the calcium carbonate feed rate is lower than the above-defined optimal value, the sulfur conversion in the furnace and the thermal efficiency in the furnace are slightly decreased, but the calcium oxide content of the ashes is decreased. According to the present invention, calcium carbonate is preferably fed to the furnace at a rate, which is about as high as, or slightly less than, the feed rate providing optimal thermal efficiency in the furnace.

The preferred Ca/S ratio is usually about 1.0. However, the thermal efficiency of the boiler is typically a rather shallow function of the Ca/S ratio, and the optimal value may in some cases differ from 1.0. For example, when combusting low-sulfur fuels, or when the sulfation is not very efficient, e.g., due to a relatively large particle size of the sulfur-reducing additive or an inefficient particle separator in the hot loop, the optimal Ca/S ratio may be slightly larger than 1.0, e.g., about 1.1 or 1.2.

In some cases, the limestone used as a sulfur-reducing additive may contain impurities, especially dolomite, which consume energy in the furnace, but do not participate in the sulfation process. Then, the effective calcination heat of the additive is higher than 178.4 kJ/kmol, and the critical value for the incremental sulfation rate is higher than the above-mentioned 35.5%. Thus, the optimal additive feed rate, in terms of thermal efficiency, is lower than for pure calcium carbonate, and is usually obtained with a Ca/S ratio of slightly less than 1.0, e.g., about 0.9 or 0.8.

According to a preferred embodiment of the present invention, the sulfur-reduction method comprises a step of enhancing the average calcium carbonate utilization efficiency in the furnace. Preferably, the step of enhancing the calcium carbonate utilization efficiency is performed so that the efficiency is more than about 60%, when the calcium carbonate feed rate stream is about the same or slightly less than its optimal value in terms of the thermal efficiency of the boiler. The calcium carbonate utilization efficiency can in practice be determined from the contents of different calcium compounds in the ashes.

According to another preferred embodiment of the present invention, the sulfur-reduction method comprises a step of enhancing the sulfation efficiency in the furnace. Preferably, the step of enhancing the sulfation efficiency is performed so that the sulfur dioxide reduction degree in the furnace is more than about 60%, when the calcium carbonate feed rate stream is about the same or slightly less than its optimal value in terms of the thermal efficiency of the boiler. The sulfur dioxide-reduction degree in the furnace can in practice be determined by analyzing the flue gases between the furnace and the sulfur dioxide-reduction stage downstream of the furnace.

The step of enhancing the calcium carbonate utilization efficiency or the sulfation degree may advantageously comprise the recycling of bottom and/or fly ashes discharged from the boiler back into the furnace. The recycling of the ashes enhances the utilization of the calcium carbonate fed into the furnace, and, thus, modifies the dependence of the sulfur dioxide reduction degree on the Ca/S ratio of the original feed streams. Generally, the recycling of ashes shifts the optimal Ca/S ratio to a lower value, and enhances the advantageous effects of the present invention.

The step of enhancing the sulfation efficiency or the sulfation degree may advantageously comprise selecting or preparing the average particle size of the sulfur reducing additive to be less than about 200 μm. Alternatively, or additionally, the step of enhancing the sulfation efficiency or the sulfation degree may advantageously comprise using a particle separator in the hot loop having a separation efficiency of at least about 99.9% for particles having an average diameter of 200 μm. The step of enhancing the sulfation efficiency or the sulfation degree may also comprise other known processes, such as enhancing the mixing of particles in the furnace or adjusting temperatures or other conditions in the boiler so as to provide rapid calcination of the calcium carbonate.

The portion of desired sulfur reduction that is not performed in the furnace is preferably performed downstream of the furnace by one of a dry, semidry, or wet sulfur-reduction process. Various suitable dry, semidry, and wet sulfur-reduction processes are well-known to persons skilled in the art, and, therefore, are not described herein.

According to another preferred embodiment of the present invention, a method of reducing sulfur dioxide emissions of a circulating fluidized bed boiler comprises steps of (a) feeding a first stream comprising sulfur-containing carbonaceous fuel to a furnace of the boiler; (b) feeding a second stream comprising calcium carbonate to the furnace at a rate relative to the first stream such that the molar ratio of calcium in the second stream to sulfur in the first stream (the Ca/S molar ratio) is at least about 0.6, and at a rate low enough to provide an incremental sulfur-reduction rate of at least about 0.355; (c) combusting the fuel so that the sulfur is oxidized to form sulfur dioxide and ashes are produced in the furnace; (d) calcining the calcium carbonate to form calcium oxide in the furnace and utilizing the calcium oxide to sulfate the sulfur dioxide to form calcium sulfate; (e) discharging flue gases and particles entrained in the flue gases from the furnace; (f) separating the particles from the flue gases using a hot loop separator, and returning the separated particles to the furnace; (g) discharging the ashes from the boiler; and (h) further reducing the sulfur content of the flue gases in a sulfur-reduction stage downstream of the furnace.

BRIEF DESCRIPTION OF THE DRAWINGS

The above brief description, as well as further objects, features, and advantages of the present invention will be more fully appreciated by reference to the following detailed description of the presently preferred, but nonetheless illustrative, embodiments in accordance with the present invention, when taken in conjunction with the accompanying drawings, wherein.

DESCRIPTION OF THE PREFERRED EMBODIMENTS

Figure 1:
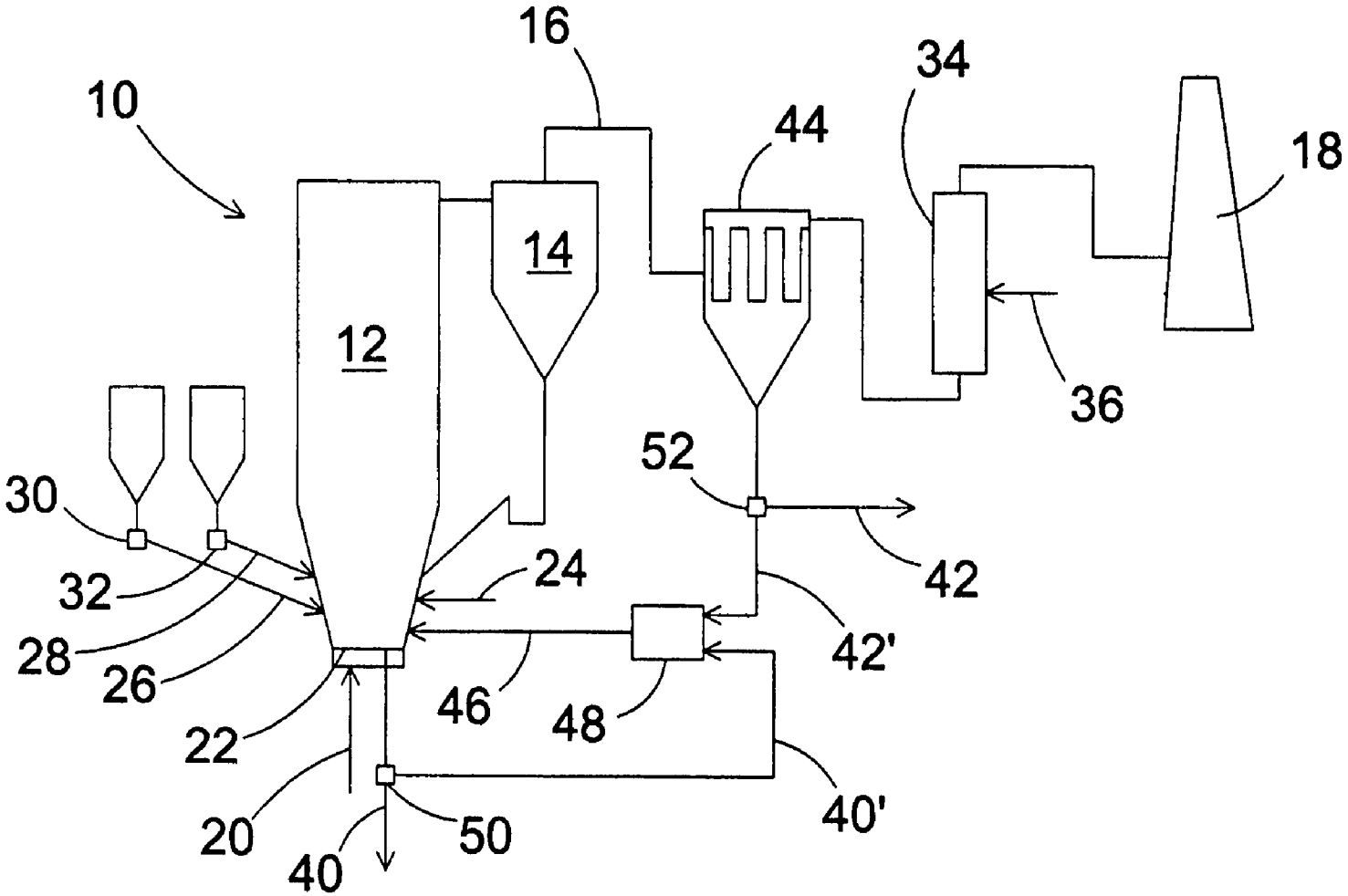
FIG. 1 is a schematic view of a CFB boiler in accordance with the present invention.

FIG. 1 schematically illustrates a preferred embodiment of a CFB boiler 10 in accordance with the present invention. The boiler comprises a furnace 12, a cyclone separator 14, and a flue gas channel 16 for directing flue gases discharged from the furnace through a stack 18 to the environment. The furnace 12 includes means 20 for feeding primary air to the furnace through a bottom grid 22, and means 24 for introducing secondary air at a higher level of the furnace. The means 20 for feeding primary air to the furnace may include, for example, a pump, ducting with a flow controller, and a wind box. The means 24 for introducing secondary air may include, for example, branch ducting and a flow controller. Secondary air can be introduced at multiple levels, but for the sake of clarity, a single level is shown in FIG. 1. Although not illustrated in FIG. 1, the flue gas channel 16 optionally may include a heat recovery area.

The furnace 12 also includes means 26 for feeding fuel into the furnace, and means 28 for introducing a sulfur-reducing additive, such as limestone, into the furnace. The means 26 and 28 for introducing the fuel and the sulfur-reducing additive may include, for example, feed hoppers or feed bins, feed channels with feed conveyors such as belts or feed screws, feeder chutes, or pneumatic feed systems. The means 26 and 28 for introducing the fuel and sulfur-reducing additive may further include means 30 and 32 for controlling the feed rates of the fuel and the additive, respectively. The means 30 and 32 for controlling the feed rates of the fuel and the additive may include, for example, feed rate controllers or supply gas controllers.

Another sulfur-reducing stage 34 is disposed downstream of the furnace 12 in the flue gas channel 16. This stage may include dry, semidry, and/or wet sulfur-reduction equipment, different types of which are well known per se, and, therefore, are not described herein. The sulfur-reducing stage 34 advantageously includes means 36 for adding a second sulfur-reducing additive, for example, calcium hydroxide, in the form of dry or semidry particles or as an aqueous slurry. The means 36 for adding the second sulfur-reducing additive may include, for example, a nozzle or a sprayer system.

Non-combustible fuel material, as well as calcium sulfate and excess calcium oxide, are removed from the furnace 12 through a bottom ash discharge duct 40, and from the flue gas through a fly ash discharge duct 42 of a dust separator 44. The dust separator 44 may advantageously be an electrostatic dust separator or a bag filter. Although in FIG. 1 the sulfur-reducing stage 34 is shown to be disposed downstream of the dust separator 44, in some cases it may advantageously be disposed upstream of a dust separator. The boiler may also include other flue gas cleaning equipment not specifically shown in FIG. 1, such as a $NO_X$ catalyst, for example.

In order to minimize the calcium oxide content of the ashes, a portion of the bottom ashes can be diverted through a line 40' and/or a portion of fly ashes can be diverted through a line 42' for recycling to the furnace 12 via a recycling line 46. The recycling of ashes enhances the degree of utilization of the calcium carbonate and the degree of reduction of sulfur dioxide emissions. The recycling line 46 may advantageously include an ash-treatment stage 48, where, for example, the ash particles can be wetted and/or broken to expose active CaO surfaces in the particles. The rate of recycling of the bottom ash or fly ash is preferably controlled by means 50 and 52, respectively, based on the CaO level in the ashes or the level of $SO_2$ in the flue gases discharged from the furnace. The means 50 and 52 for controlling the rate of ash recycling may include, for example, valves or fluidized bed dividers.

Preferably, in accordance with the method described above, the utilization degree of the calcium carbonate is enhanced to about 60% or more. Preferably, the sulfation efficiency in the furnace, i.e., the degree of sulfur reduction, is enhanced to about 60% or more.

When using conventional limestone feed rates and CFB furnace temperatures (i.e., 750-900° C.), all calcium carbonate fed into the furnace is calcined to calcium oxide. Thus, the energy required for calcination is linearly proportional to the limestone feed rate, or the Ca/S ratio, as is shown by line 1 in FIG. 2. Correspondingly, the sulfation of sulfur dioxide and the release of sulfation energy increase as the Ca/S ratio increases, but with a decreasing slope. Two slightly different variations of the dependency of the sulfation energy on the Ca/S ratio are shown by lines 2 and 2' in FIG. 2. Line 2' represents a sulfation process that is somewhat more efficient than that represented by line 2.

Figure 2:
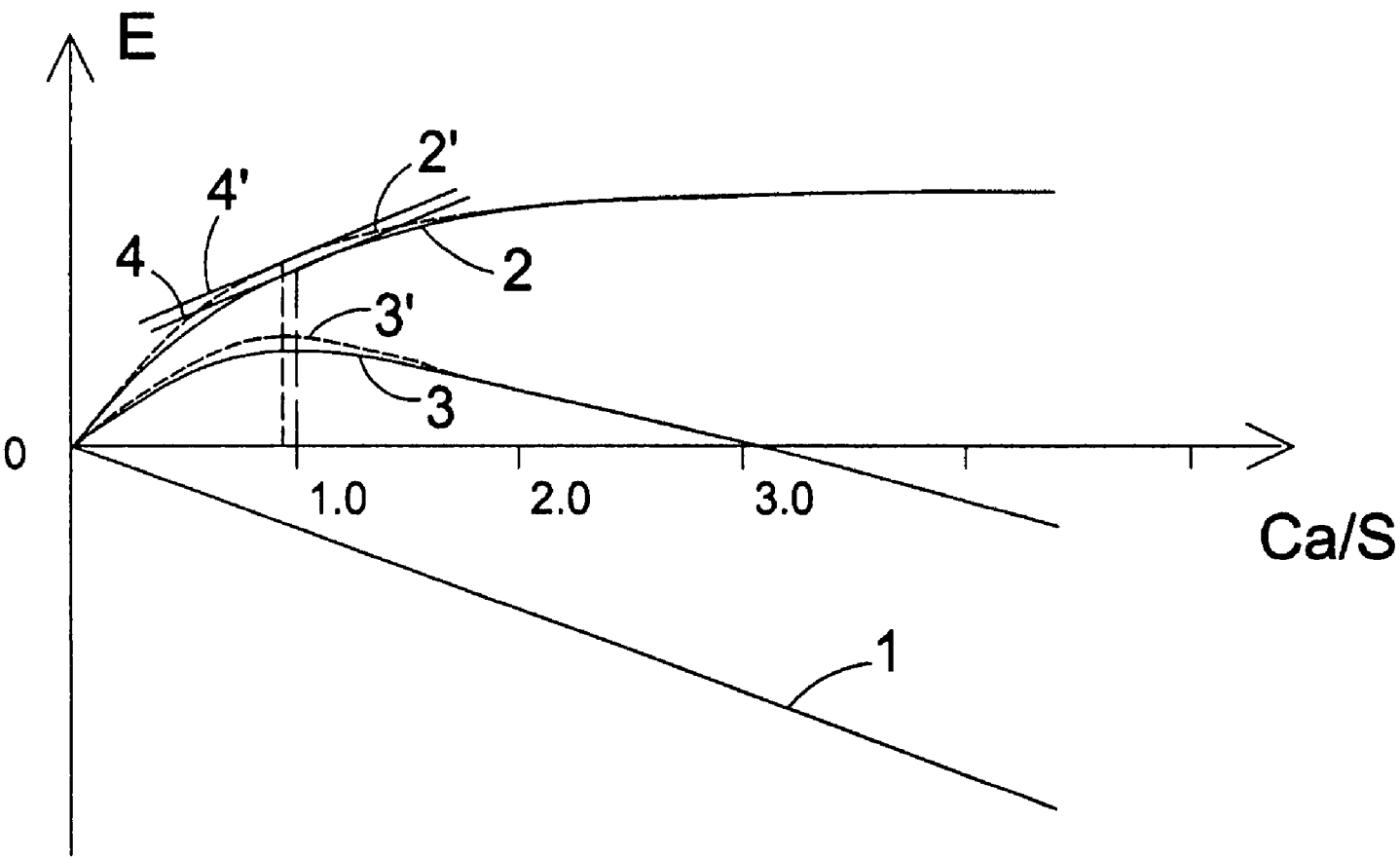
FIG. 2 is a schematic diagram of different reaction heats as a function of Ca/S ratio in a CFB boiler.

The net energy release functions, represented by lines 3 and 3' in FIG. 2, are the sums of lines 1 and 2, and 1 and 2', respectively. Line 3 reaches its maximum when the Ca/S ratio is about 1.0, and line 3' reaches its maximum when the Ca/S is about 0.9. Both maximum points occur at a Ca/S ratio where the sulfation energy curves 2 and 2' have the same slope 4 and 4', respectively. This slope 4 and 4' is opposite to the slope of line 1, so that the sum curves 3 and 3' are horizontal at their maximum points.

Preferably, a Ca/S ratio of about 1.0, or slightly less than 1.0, is used in the furnace of a CFB boiler comprising a further sulfur-reduction stage in the flue gas path. When the relation between the furnace sulfur reduction and the Ca/S ratio is accurately known, a limestone feed rate providing an incremental sulfur-reduction rate in the furnace of about 0.355 or more is preferred. This value of 0.355 corresponds to the ratio of the reaction heats of calcination and sulfation, 178.4 kJ/kmol and 502.4 kJ/kmol, respectively. Higher limestone feed rates, i.e., those where less than 0.355 of the added limestone leads to sulfation, result in decreased thermal efficiency, and, therefore, are less than optimal for use in connection with the present invention.

The fixed costs of incorporating a sulfur-reduction stage in the flue gas path downstream of the furnace are relatively high. The capacity of the process depends on the number of pumps and spraying levels of the system, but generally the fixed costs do not depend strongly on the amount of sulfur reduction desired in the process. Thus, on the basis of the fixed costs, it is not particularly beneficial to minimize the downstream sulfur reduction. The variable costs of a downstream process are typically linearly proportional to the sulfur-reduction rate. Usually, downstream sulfur-reduction processes require more expensive additives than the furnace-based process. However, the utilization degree of the additives in downstream processes is usually very high, and disposal costs, at least in some processes, are relatively low.

For furnace-based sulfur reduction, the fixed costs are relatively small. The variable costs depend non-linearly on the desired level of sulfur reduction, due to the above-described effect on the thermal efficiency and the harmful increase of CaO in the ashes.

It has been found that an especially advantageous sulfur-reduction process is obtained by combining sulfur reduction in the furnace with a downstream sulfur-reduction stage, wherein only a limited amount of sulfur reduction takes place in the furnace. According to a preferred embodiment of the present invention, the sulfur reduction in the furnace is limited by providing a Ca/S molar ratio of about 1.2 or less in the furnace. The Ca/S ratio is preferably between about 1.2 and about 0.6, more preferably between about 1.2 and about 0.8, and most preferably between about 1.2 and about 0.9.

In some cases the sulfur reduction in the furnace is advantageously limited by providing a Ca/S molar ratio of about 1.0 or less in the furnace. In those cases, the Ca/S ratio is preferably between about 1.0 and about 0.6, more preferably between about 1.0 and about 0.8, and most preferably between about 1.0 and about 0.9.

The most preferable Ca/S ratio varies according to the dependence of the furnace sulfur reduction on the Ca/S ratio. If the furnace reduction is especially effective, the Ca/S ratio which is most preferable in terms of thermal efficiency may be slightly less than 1.0. If the furnace reduction is less effective, then the most preferred Ca/S ratio may be slightly greater than 1.0, e.g., about 1:2. The present invention can advantageously be combined with conventional measures to enhance the furnace sulfur reduction, such as particle size control and/or ash recycling, whereby the optimal Ca/S ratio in the furnace can be lowered.

According to a preferred embodiment of the present invention, the Ca/S ratio is about 1.0, or slightly less than 1.0, and the bottom ashes and/or fly ashes discharged from the furnace are recycled as bed material to the furnace in order to reduce the amount of CaO in the ashes by using it for sulfur reduction in the furnace. Preferably, the ashes are recycled to the furnace so as to provide a utilization degree of the originally fed calcium carbonate of more than about 60%, whereby the disposal or utilization of the ashes removed from the furnace becomes relatively easy. Even more preferably, the ashes are recycled to the furnace so as to provide a sulfur dioxide-reduction degree of more than about 60% in the furnace. The loop for recycling bottom ash and/or fly ash may advantageously comprise a stage for treating the ashes, e.g., by breaking ash particles to expose active CaO surfaces.

In an example, based on calculations for a 400 MWe CFB boiler combusting brown coal, a net thermal efficiency gain of the whole power plant from 40.75% to 41.60% was obtained by replacing a sulfur reduction solely in the furnace with a sulfur-reduction split between the furnace and a flue gas sulfur-reduction stage. In both cases, the same total sulfur reduction was obtained. The net efficiency gain of 0.85 percentage points is of considerable economical value.

In the split sulfur-reduction mode of the above example, the molar Ca/S ratio in the furnace was close to 1.0, whereas in the case based on sulfur reduction in the furnace only, the ratio was about 4. In the split-reduction mode, calcium was fed also in the downstream reduction stage, but the total calcium consumption was only about 44% of that in the furnace-based reduction mode. Thus, the ash and waste disposal problems are minimized with the split sulfur-reduction process in accordance with the present invention.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

What is claimed is:

1. A method of reducing sulfur dioxide emissions of a circulating fluidized bed boiler, comprising the steps of:

(a) feeding a first stream comprising a sulfur-containing carbonaceous fuel to a furnace of the boiler;

(b) feeding a second stream comprising calcium carbonate to the furnace at a rate relative to the first stream such that the molar ratio of calcium in the second stream to sulfur in the first stream (the Ca/S molar ratio) is at most about 1.0;

(c) combusting the fuel so that the sulfur is oxidized to form sulfur dioxide and ashes are produced in the furnace;

(d) calcining the calcium carbonate to form calcium oxide in the furnace and utilizing the calcium oxide to sulfate the sulfur dioxide to form calcium sulfate;

(e) discharging flue gases and particles entrained in the flue gases from the furnace;

(f) separating the particles from the flue gases using a hot loop separator, and returning the separated particles to the furnace;

(g) discharging the ashes from the boiler; and (h) further reducing the sulfur content of the flue gases in a sulfur-reduction stage downstream of the furnace.

2. The method of claim 1, wherein the Ca/S molar ratio is between about 0.6 and about 1.0.

3. The method of claim 1, wherein the Ca/S molar ratio is between about 0.8 and about 1.0.

4. The method of claim 1, wherein the Ca/S molar ratio is between about 0.9 and about 1.0.

5. The method of claim 1, wherein the further sulfur reduction is performed by one of a dry, semidry, and wet sulfur-reduction process.

6. The method of claim 1, further comprising a step of enhancing the calcium carbonate utilization efficiency in the furnace.

7. The method of claim 6, wherein the step of enhancing the calcium carbonate utilization efficiency is performed so that more than about 60% of the calcium carbonate is utilized for sulfating the sulfur dioxide to form calcium sulfate.

8. The method of claim 6, wherein the step of enhancing the calcium carbonate utilization efficiency comprises recycling the ashes to the furnace.

9. The method of claim 6, wherein the step of enhancing the calcium carbonate utilization efficiency comprises limiting the mean diameter of the calcium carbonate fed into the furnace to less than about 200 μm.

10. The method of claim 6, wherein the step of enhancing the calcium carbonate utilization efficiency comprises configuring the hot loop separator to have a separation efficiency of at least about 99.9% for particles having a diameter of 200 μm.

11. The method of claim 1, further comprising a step of enhancing the sulfation efficiency in the furnace.

12. The method of claim 11, wherein the step of enhancing the sulfation efficiency is performed so that more than about 60% of the sulfur dioxide is converted to calcium sulfate in the furnace.

13. The method of claim 11, wherein the step of enhancing the sulfation efficiency comprises recycling the ashes to the furnace.

14. The method of claim 11, wherein the step of enhancing the sulfation efficiency comprises limiting the mean diameter of the calcium carbonate fed into the furnace to less than about 200 μm.

15. The method of claim 11, wherein the step of enhancing the sulfation efficiency comprises configuring the hot loop separator to have a separation efficiency of at least about 99.9% for particles having a diameter of 200 μm.

16. A method of reducing sulfur dioxide emissions of a circulating fluidized bed boiler, comprising the steps of:

(a) feeding a first stream comprising sulfur-containing carbonaceous fuel to a furnace of the boiler;

(b) feeding a second stream comprising calcium carbonate to the furnace at a rate relative to the first stream such that the molar ratio of calcium in the second stream to sulfur in the first stream (the Ca/S molar ratio) is at least about 0.6, and at a rate low enough to provide an incremental sulfur-reduction rate of at least about 0.355;

(c) combusting the fuel so that the sulfur is oxidized to form sulfur dioxide and ashes are produced in the furnace;

(d) calcining the calcium carbonate to form calcium oxide in the furnace and utilizing the calcium oxide to sulfate the sulfur dioxide to form calcium sulfate;

(e) discharging flue gases and particles entrained in the flue gases from the furnace;

(f) separating the particles from the flue gases using a hot loop separator, and returning the separated particles to the furnace;

(g) discharging the ashes from the boiler; and (h) further reducing the sulfur content of the flue gases in a sulfur-reduction stage downstream of the furnace.

17. The method of claim 16, wherein the further sulfur reduction is performed by one of a dry, semidry, and wet sulfur-reduction process.

18. The method of claim 16, further comprising a step of enhancing the calcium carbonate utilization efficiency in the furnace.

19. The method of claim 18, wherein the step of enhancing the calcium carbonate utilization efficiency is performed so that more than about 60% of the calcium carbonate is utilized for sulfating the sulfur dioxide to form calcium sulfate.

20. The method of claim 18, wherein the step of enhancing the calcium carbonate utilization efficiency comprises recycling the ashes to the furnace.

21. The method claim 18, wherein the step of enhancing the calcium carbonate utilization efficiency comprises limiting the mean diameter of the calcium carbonate fed into the furnace to less than about 200 μm.

22. The method of claim 18, wherein the step of enhancing the calcium carbonate utilization efficiency comprises configuring the hot loop separator to have a separation efficiency of at least about 99.9% for particles having a diameter of 200 μm.

23. The method of claim 16, further comprising a step of enhancing the sulfation efficiency in the furnace.

24. The method of claim 23, wherein the step of enhancing the sulfation efficiency is performed so that more than about 60% of the sulfur dioxide is converted to calcium sulfate in the furnace.

25. The method of claim 23, wherein the step of enhancing the sulfation efficiency comprises recycling the ashes to the furnace.

26. The method of claim 23, wherein the step of enhancing the sulfation efficiency comprises limiting the mean diameter of the calcium carbonate fed into the furnace to less than about 200 μm.

27. The method of claim 23, wherein the step of enhancing the sulfation efficiency comprises configuring the hot loop separator to have a separation efficiency of at least about 99.9% for particles having a diameter of 200 μm.

* * * * *